US010879645B2

(12) United States Patent
Zhang et al.

(10) Patent No.: US 10,879,645 B2
(45) Date of Patent: Dec. 29, 2020

(54) ELECTRICAL CONNECTION DEVICE

(71) Applicant: Molex, LLC, Lisle, IL (US)

(72) Inventors: Cun-Dong Zhang, ChengDu (CN); Paul Berg, Rochester Hills, MI (US); Jun Deng, ChengDu (CN); Cheng-Bing Qiu, ChengDu (CN); Hong-Wei Bai, ChengDu (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/734,409

(22) Filed: Jan. 6, 2020

(65) Prior Publication Data

US 2020/0220298 A1 Jul. 9, 2020

(30) Foreign Application Priority Data

Jan. 9, 2019 (CN) ..... 2019 2 0036184 U

(51) Int. Cl.
*H01R 13/52* (2006.01)
*H01R 13/41* (2006.01)
*H01R 13/74* (2006.01)

(52) U.S. Cl.
CPC ..... *H01R 13/5202* (2013.01); *H01R 13/41* (2013.01); *H01R 13/748* (2013.01)

(58) Field of Classification Search
CPC ..... H01R 13/5202
USPC ..... 439/556, 559
See application file for complete search history.

(56) References Cited

U.S. PATENT DOCUMENTS 2,786,359 A * 3/1957 Karlan ..... F16J 15/52 403/50
4,433,889 A * 2/1984 Ratchford ..... H01R 13/74 439/272
4,447,103 A * 5/1984 Werth ..... H01R 13/5219 439/152
4,820,181 A 4/1989 Kuzuno et al.
5,947,766 A * 9/1999 Tsuji ..... H01R 13/748 439/559
6,792,719 B2 * 9/2004 Lawrie ..... B60R 11/02 49/349
6,953,357 B2 10/2005 Fukushima et al.
7,329,145 B2 * 2/2008 Yagome ..... H01R 13/506 439/271
7,341,484 B2 * 3/2008 Yamamoto ..... H01R 13/5202 439/271

(Continued)

*Primary Examiner* — Neil Abrams
(74) *Attorney, Agent, or Firm* — Molex, LLC

(57) ABSTRACT

An electrical connection device has an electrical connector and a sealing member. The connector has an insulating housing which has an abutting face. The sealing member is provided to the housing and is adapted to be abutted between the face and a panel of an electronic device. The sealing member has an annular body, two first annular ribs, a plurality of second annular ribs and a plurality of positioning posts. The annular body has first and second surfaces and a plurality of penetrating holes penetrating the first and second surfaces. The first annular ribs respectively protrude from the first and second surfaces, and are adapted to respectively abut the panel and the face. The second annular ribs respectively protrude from the first and second surfaces, encircle the penetrating holes respectively, and are adapted to abut the panel and the face.

13 Claims, 14 Drawing Sheets

(56) References Cited

U.S. PATENT DOCUMENTS

| | | | | |
|---|---|---|---|---|
| 7,828,591 | B2 * | 11/2010 | Matsuoka | H01R 13/5202 439/559 |
| 8,167,634 | B2 * | 5/2012 | Fujiwara | H01R 13/748 439/271 |
| 8,187,030 | B2 * | 5/2012 | Matsuoka | H01R 13/5202 439/542 |
| 8,366,470 | B2 * | 2/2013 | Sakakura | H01R 13/5202 439/272 |
| 9,059,534 | B2 * | 6/2015 | Endo | H01R 13/5205 |
| 9,318,849 | B2 * | 4/2016 | Kobayashi | H01R 13/5216 |
| 9,413,099 | B2 * | 8/2016 | Vanslambrouck | H01R 13/521 |
| 9,608,360 | B1 * | 3/2017 | Yang | H01R 13/5219 |
| 10,630,021 | B2 * | 4/2020 | Shiraishi | H01R 12/716 |
| 2020/0220298 | A1 * | 7/2020 | Zhang | H01R 13/746 |

* cited by examiner

ELECTRICAL CONNECTION DEVICE

RELATED APPLICATIONS

This application claims priority to Chinese Application No. 201920036184.5 filed on Jan. 9, 2019, which is incorporated herein by reference in its entirety.

TECHNICAL FIELD

The present disclosure relates to an electrical connection device, and specifically relates to a waterproof electrical connection device.

BACKGROUND

U.S. Pat. No. 4,820,181 discloses an existing waterproof electrical connector which comprises a male connector, a female connector and a sealing member. The male connector comprises an outer wall and a waterproof wall connecting to a periphery of the outer wall. The outer wall and the waterproof wall together define a cavity. The sealing member is provided to the cavity. The female connector comprises a hollow columnar portion which may insert into the cavity and press against the sealing member. In addition, U.S. Pat. No. 6,953,357 discloses an existing connector and a sealing member. The connector comprises a plurality of cylindrical portions accommodating terminals, a recessed groove encircling the plurality of cylindrical portions and two receiving holes. The sealing member is provided to the recessed groove and has two fixing portions correspondingly mounted to the receiving holes.

The existing electrical connector is usually connected to a panel or a housing, is aligned with a mounting hole of the panel or the housing, and allow another electrical connector to correspondingly mate therewith. However, there is no good waterproof effect between the existing electrical connector and the panel.

SUMMARY

Therefore, one of objects of the present disclosure is to provide an electrical connection device which can improve the waterproof effect.

Therefore, in some embodiments, the present disclosure provides an electrical connection device which is adapted to be fixed to a panel by a plurality of fasteners, the panel has a mounting hole and a plurality of through holes around the mounting hole and respectively allowing the plurality of fasteners to pass through. The electrical connection device comprises an electrical connector and a sealing member. The electrical connector comprises an insulating housing and a plurality of terminals. The insulating housing has a base portion and a mating portion. The base portion has an abutting face, the mating portion protrudes from the abutting face, the base portion further has a positioning hole which is formed on the abutting face and positioned around the mating portion and a plurality of fastening holes which are formed on the abutting face and adapted to be respectively aligned with the plurality of through holes of the panel and allow the plurality of fasteners to correspondingly insert therein. The plurality of terminals are provided to the insulating housing. The sealing member is provided to the insulating housing and is adapted to be abutted between the abutting face and the panel. The sealing member comprises an annular body, two first annular ribs, a plurality of second annular ribs and a positioning post. The annular body has an opening allowing the mating portion to pass through, a first surface adapted to face the panel, a second surface facing the abutting face and a plurality of penetrating holes penetrating the first surface and the second surface, the plurality of penetrating holes are respectively adapted to be aligned with the plurality of through holes of the panel and the plurality of fastening holes of the insulating housing so as to allow the plurality of fasteners to correspondingly pass through. The first annular ribs protrude respectively from the first surface and the second surface and encircle the opening therein, the first annular rib positioned on the first surface is adapted to abut the panel, the first annular rib positioned on the second surface is used to abut the abutting face. The plurality of second annular ribs protrude respectively from the first surface and the second surface, the second annular ribs positioned on the first surface encircle the plurality of penetrating holes respectively and are adapted to abut the panel, the second annular ribs positioned on the second surface encircle the plurality of penetrating holes respectively and are used to abut the abutting face. The positioning post protrudes from the second surface, the positioning post has a free end portion which is enlarged and used to be fixed to the positioning hole.

In some embodiments, each terminal has a fixed portion which is embedded in the base portion of the insulating housing and a contact portion which extends from the fixed portion and exposes to the mating portion.

In some embodiments, the first annular ribs are connected with the plurality of second annular ribs.

In some embodiments, the first annular ribs are adjacent to a periphery of the annular body, and the first annular rib positioned on the second surface encircles the positioning post.

In some embodiments, the plurality of fastening holes are blind holes.

In some embodiments, the base portion further has a rear face which is opposite to the abutting face, the free end portion of the positioning post passes through the positioning hole and abuts the rear face, the sealing member further comprises a third annular rib which is provided to the second surface and encircles the positioning post.

In some embodiments, the positioning hole is a blind hole, the base portion further has a hole wall which defines the positioning hole, the free end portion of the positioning post is tightly fitted to the hole wall.

In some embodiments, the first annular ribs are the same as the plurality of second annular ribs in height.

In some embodiments, n the sealing member further has a plurality of supporting ribs which are provided to the first surface, the plurality of supporting ribs are the same as the first annular ribs and the plurality of second annular ribs in height.

In some embodiments, the plurality of fastening holes are threaded holes, the plurality of fasteners are threaded locking members which cooperate with the plurality of fastening holes respectively.

In some embodiments, the positioning post is mushroom-shaped (toadstool-shaped).

In some embodiments, the positioning hole of the base portion is provided as plurality in number, the plurality of positioning holes are distributed around the mating portion, the positioning post of the sealing member is provided as plurality in number, the plurality of positioning posts are respectively cooperated with the plurality of positioning holes.

In some embodiments, the base portion further has a rear face which is opposite to the abutting face, the free end portions of the plurality of positioning posts pass through the plurality of positioning holes respectively and abut the rear face, the sealing member further comprises a plurality of third annular ribs which are provided to the second surface and respectively encircles the plurality of positioning post.

The present disclosure at least has the following beneficial effects: the first annular ribs are formed on two opposite surfaces of the annular body of the sealing member along the periphery, correspondingly abut the panel and the abutting face of the electrical connector, so that moisture is prevented from seeping into the electronic device via the mounting hole of the panel; furthermore, the second annular rib encircles the penetrating hole of the annular body, so that the moisture can also be further prevented from seeping into the electronic device via the through hole of the panel.

BRIEF DESCRIPTION OF THE DRAWINGS

Other features and effects of the present disclosure will be apparent from the embodiments illustrated in the accompanying drawings, in which.

DETAILED DESCRIPTION OF THE PREFERRED EMBODIMENTS

Figure 1:
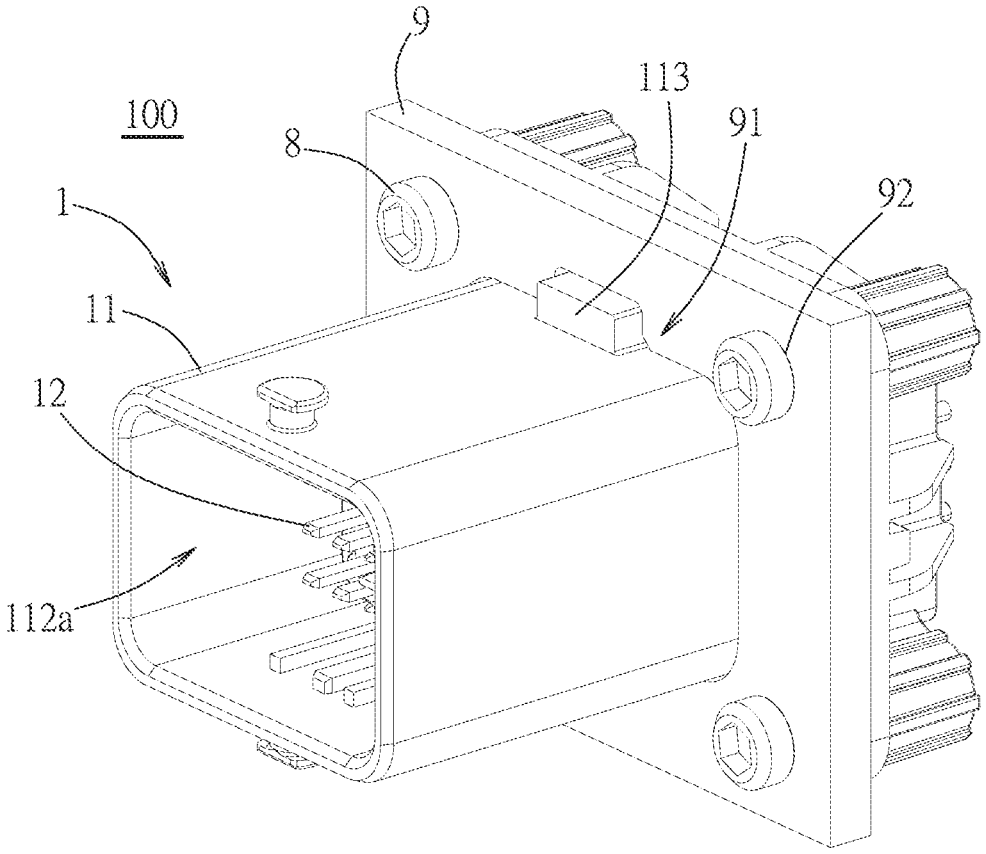
FIG. 1 is a perspective view of a first embodiment of an electrical connection device of the present disclosure.

Before the present disclosure is described in detail, it should be noted that the similar components are indicated by the same reference numerals in the following description.

Figure 2:
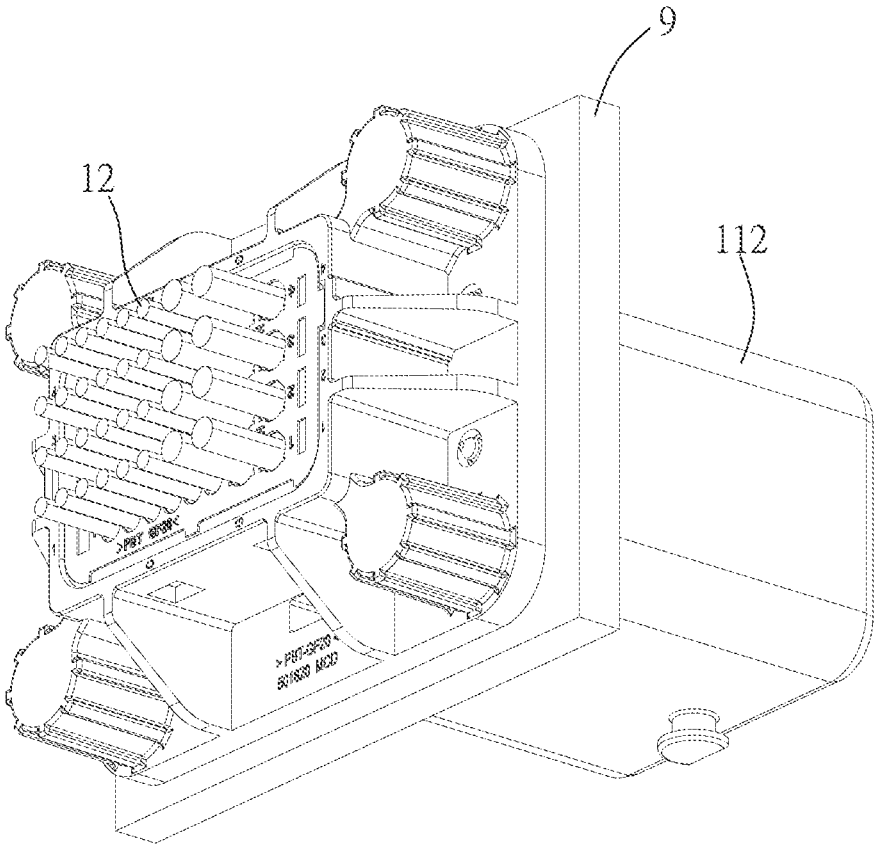
FIG. 2 is a view of FIG. 1 from another angle.
Figure 3:
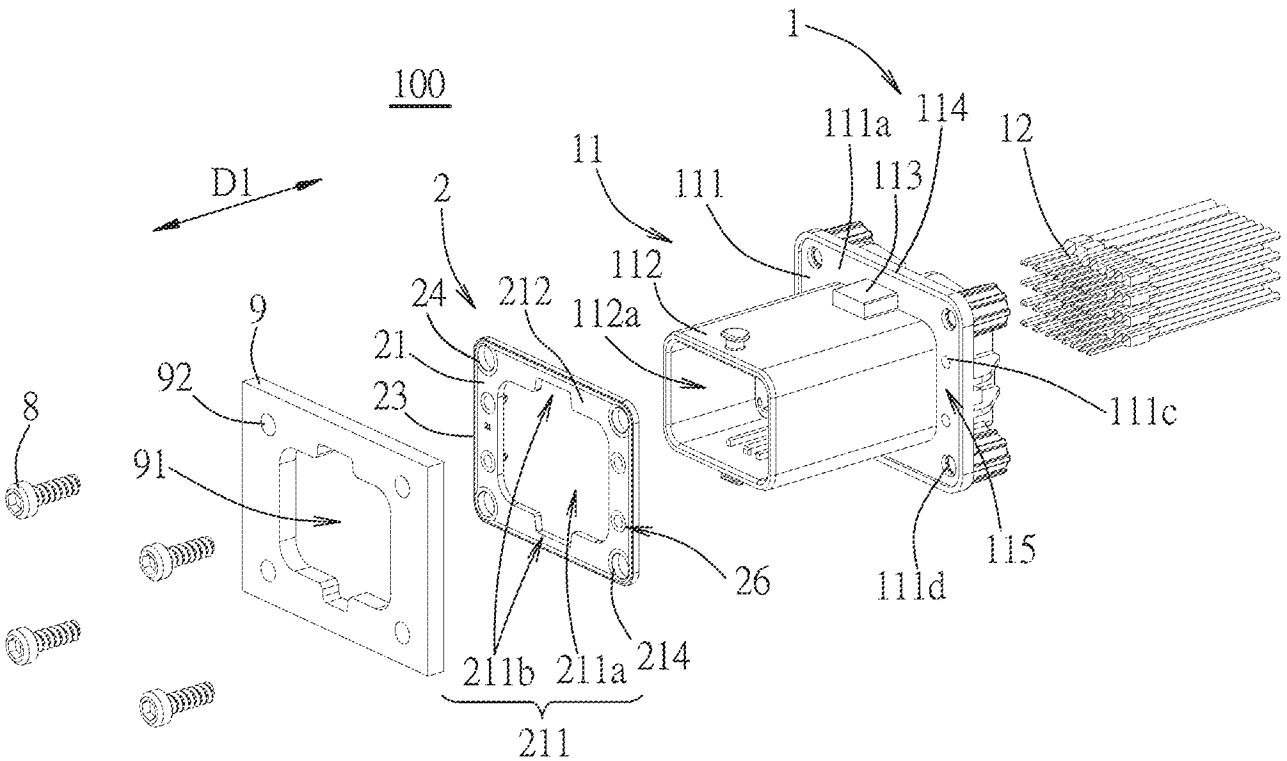
FIG. 3 is an exploded perspective view of the first embodiment.

Referring to FIG. 1 to FIG. 3, a first embodiment of the electrical connection device 100 of the present disclosure is adapted to be fixed to a panel 9 of an electronic device (not shown in figures) by fasteners 8. In the embodiment, the fasteners 8 may be bolts, screws or other threaded locking members. The panel 9 may be, for example, a part of a casing of the electronic device or a part of a control panel, and the panel 9 has a mounting hole 91 and four through holes 92 around the mounting hole 91. The mounting hole 91 allows the electrical connection device 100 to pass through, so that a part of the electrical connection device 100 exposes outside the electronic device 100. The plurality of through holes 92 allow the plurality of fasteners 8 to correspondingly pass through and be locked to the electrical connection device 100, so that the electrical connection device 100 is locked to the panel 9.

Figure 4:
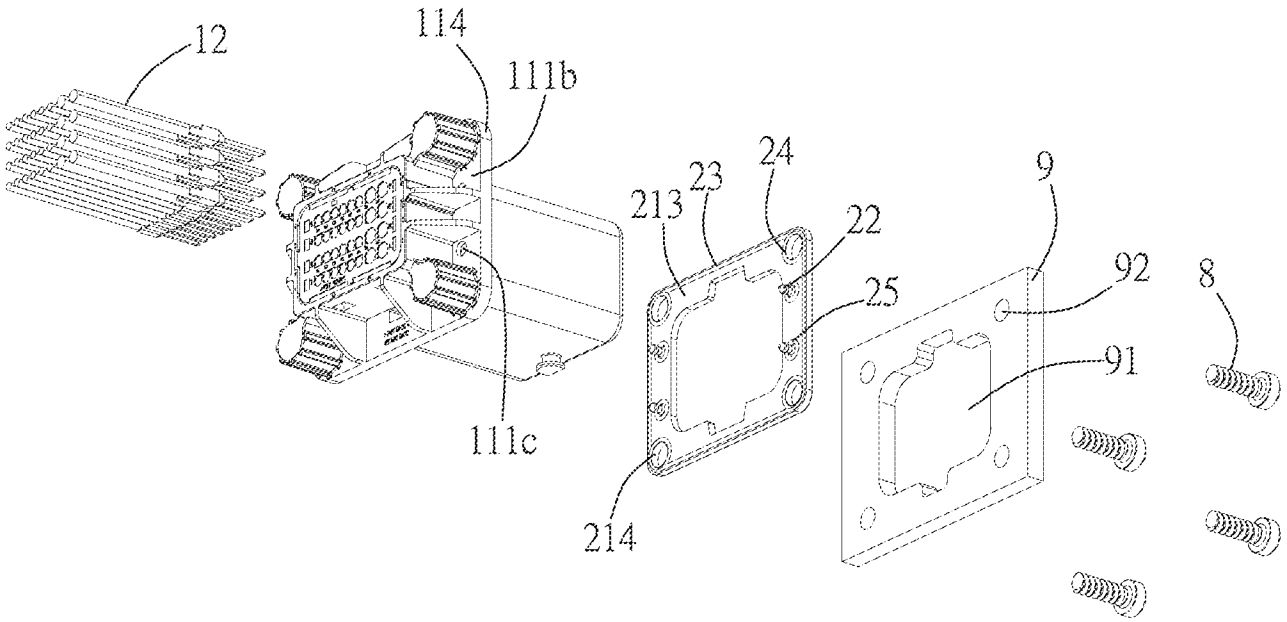
FIG. 4 is a view of FIG. 3 from another angle.

Referring to FIG. 3 to FIG. 4, the electrical connection device 100 comprises an electrical connector 1 and a sealing member 2. In the embodiment, the sealing member 2 sheathes and is fixed to the electrical connector 1 in advance, and then the electrical connector 1 is assembled to the panel 9, so that the sealing member 2 is abutted closely between the panel 9 and the electrical connector 1.

The electrical connector 1 comprises an insulating housing 11 and a plurality of terminals 12. In the embodiment, the insulating housing 11 covers the plurality of terminals 12 by insert molding technique to prevent moisture from seeping into the electronic device from a gap between the terminal 12 and the insulating housing 11. Specifically, the insulating housing 11 has a base portion 111, a mating portion 112, two guiding portions 113 and a surrounding wall portion 114.

The base portion 111 has an abutting face 111*a* which is substantially rectangular, a rear face 111*b* opposite to the abutting face 111, four positioning holes 111*c* penetrating the abutting face 111*a* and the rear face 111*b* and four fastening holes 111*d* respectively recessed inwardly from the abutting face 111*a*. In the embodiment, the plurality of fastening holes 111*d* are threaded holes, and the plurality of fastening holes 111*d* are blind holes which do not penetrate the base portion 111.

In the embodiment, the mating portion 112 substantially is a quadrangular cylinder in shape, protrudes forwardly from a center of the abutting face 111*a* and defines a mating cavity 112*a* having an opening facing forwardly. The mating portion 112 passes through the mounting hole 91 of the panel 9 to allow another electrical connector (not shown in figures) to correspondingly mate therewith.

The guiding portions 113 are respectively formed on opposite side surfaces of the mating portion 112 and connect to the abutting face 111*a*, and in the embodiment, the guiding portions 113 respectively are positioned at two long sides of the mating portion 112. A cross-sectional contour which is formed by the connected guiding portions 113 and mating portion 112 is matched with a contour of the mounting hole 91, such that when the electrical connector 1 is mounted to the panel 9, the guiding portions 113 and the mating portion 112*a* together pass through the mounting hole 91, which provides the effect of guiding and aligning.

The surrounding wall portion 114 extends forwardly from a periphery of the base portion 111, and the surrounding wall portion 114 and the abutting face 111*a* of the base portion 111 together define an accommodating groove 115 to allow the sealing member 2 to be accommodated therein.

Figure 5:
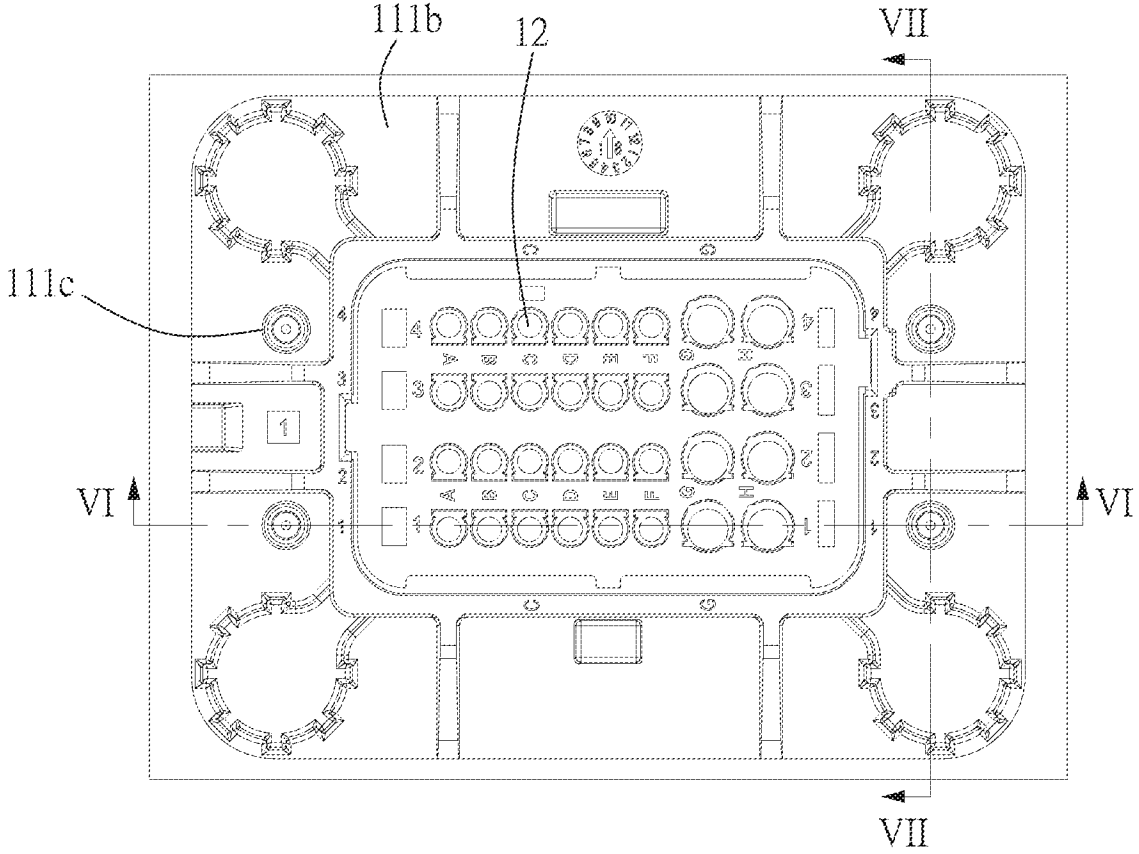
FIG. 5 is a rear view of the first embodiment.
Figure 6:
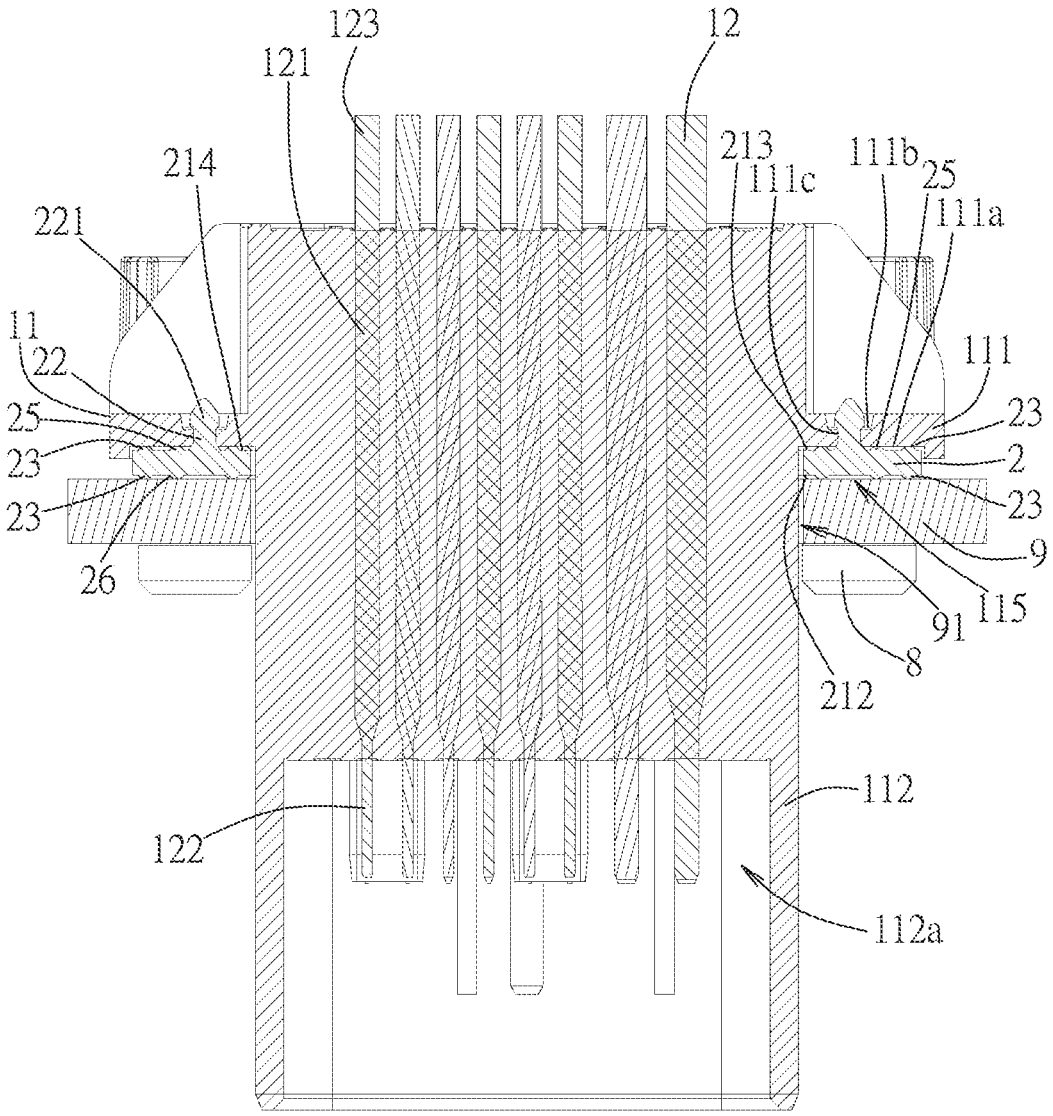
FIG. 6 is a cross-sectional view taken along a line VI-VI of FIG. 5.

In combination with referring to FIG. 5 and FIG. 6, the plurality of terminals 12 are arranged in four rows in an up-down direction, and the terminals 12 in each row are partially embedded in the insulating housing 11. Specifically, each terminal 12 has a fixed portion 121 which is embedded in the base portion 111 of the insulating housing 11, a contact portion 122 which extends forwardly from an end of the fixed portion 121*a*, is not embedded in the insulating housing 11 and exposes to the mating cavity 112*a*, and a tail portion 123 which extends backwardly from an end of the fixed portion 121*a* and extends out of the base portion 111. By that the plurality of terminals 12 are embedded in the base portion 111, when the moisture exists in the mating cavity 112*a*, the base portion 111 correspondingly positioned in the mating cavity 112*a* can prevent the moisture from seeping into the electronic device.

Continuing to refer to FIG. 3 and FIG. 4, the sealing member 2 is provided to the accommodating groove 115 of the insulating housing 11, and is abutted between the abutting face 111*a* and the panel 9. In the embodiment, a material of the sealing member 2 is rubber and the sealing member 2 comprises an annular body 21, four positioning posts 22, two first annular ribs 23, eight second annular ribs 24, four third annular ribs 25 and four supporting ribs 26.

The annular body 21 is matched with the accommodating groove 115 in shape, and has an opening 211, a first surface 212 and a second surface 213 positioned at opposite sides, and four penetrating holes 214 penetrating the first surface 212 and the second surface 213. The opening 211 is the same as the mounting hole 91 of the panel 9 in shape, and has an insertion opening portion 211*a* which has a substantially quadrilateral cross section to allow the mating portion 112 to pass through and two guide opening portions 211*b* which extend respectively from an upper side and a lower side of the insertion opening portion 211*a*. In the process that the sealing member 2 is assembled to the electrical connector 1, the sealing member 2 may be guided to and aligned with the electrical connector 1 by the guide opening portions 211*b* and the guiding portions 113 of the insulating housing 11, thereby facilitating assembling, and when assembled, the second surface 213 faces the abutting face 111*a* and the first surface 212 faces the panel 9. The penetrating holes 214 correspond to the through holes 92 of the panel 9 and the fastening holes 111*d* of the base portion 111 in a front-rear direction Dl.

Figure 7:
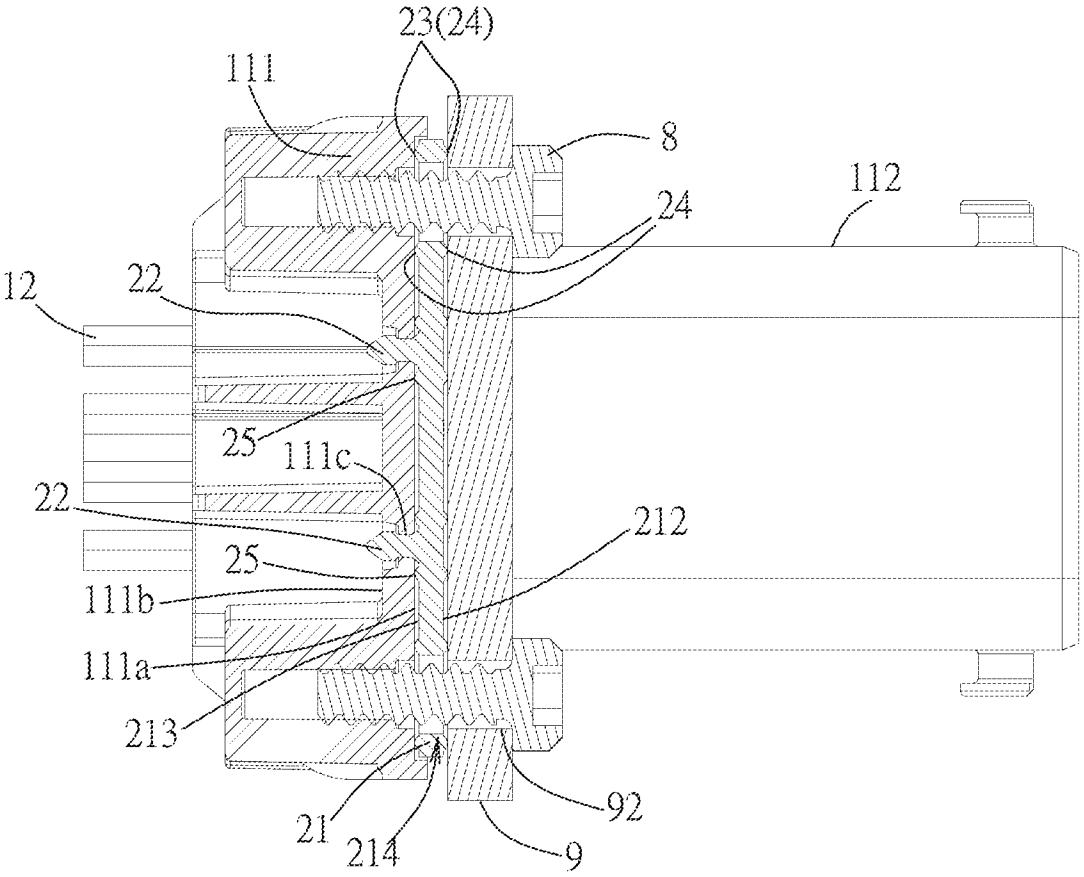
FIG. 7 is a cross-sectional view taken along a line VII-VII of FIG. 5.

Together referring to FIG. 6 and FIG. 7, the positioning posts 22 protrude from the second surface 213, and two adjacent positioning posts 22 are one pair, two pairs of positioning posts 22 are respectively adjacent to two short sides of the annular body 21, and each pair of positioning posts 22 is positioned between the two penetrating holes 214. Each positioning post 22 is mushroom-shaped (toadstool-shaped), and has a free end portion 221 which is enlarged. The positioning posts 22 are used to pass through the positioning holes 111*c* of the base portion 111 and are correspondingly limited by the positioning holes 111*c*. Specifically, in the embodiment, when the positioning posts 22 pass through the positioning holes 111*c* respectively, the free end portions 221 abut the rear face 111*b* of the base portion 111, therefore the sealing member 2 and the insulating housing 11 are fixed relative to each other. Then, the fasteners 8 pass through the through holes 92 and the penetrating holes 214 sequentially, and inserted into the fastening holes 111*d* to be locked to the base portion 111, so that the electrical connector 1 is locked to the panel 9, therefore, the sealing member 2 can be clamped tightly between the panel 9 and the abutting face 111*a* of the insulating housing 11. In the embodiment, "insert into" means a first object enters into a hole defined by a second object, and the first object does not pass through the second object, so that an end of the first object enters into the second object does not expose outside the second object, but the other embodiments are not limited to the above definition. In addition, the positioning post 22 and the positioning hole 111*c* may be matched in number and each provided as one in number in a varied embodiment, the same effect that the sealing member 2 and the insulating housing 11 are fixed relative to each other can be achieved.

The two first annular ribs 23 protrude respectively from the first surface 212 and the second surface 213 of the annular body 21, and encircle the opening 211 along a periphery of the annular body 21 therein. The first annular rib 23 positioned on the first surface 212 abuts the panel 9, which prevents moisture from seeping into the electronic device through a gap between the first surface 212 and the panel 9 via the mounting hole 91. The first annular rib 23 positioned on the second surface 213 encircles the positioning posts 22 therein, and abuts the abutting face 111*a* of the base portion 111, which further prevents moisture from seeping into the electronic device through a gap between the second surface 213 and the abutting face 111*a* via the mounting hole 91 and the opening 211.

The second annular ribs 24 protrude respectively from the first surface 212 and the second surface 213 of the annular body 21 and are the same as the first annular ribs 23 in height. In all the second annular ribs 24, four second annular ribs 24 positioned on the first surface 212 respectively encircle the penetrating holes 214 and are used to abut the panel 9, the other four second annular ribs 24 positioned on the second surface 213 respectively encircle the penetrating holes 214 and are used to abut the abutting face 111*a*.

In the embodiment, the penetrating holes 214 are respectively positioned at four corners of the annular body 21, and both the first annular rib 23 on the first surface 212 and the first annular rib 23 on the second surface 213 encircle the penetrating holes 214 therein. Further, the second annular ribs 24 and the first annular rib 23 which are positioned on the first surface 212 are connected at the four corners of the annular body 21, and the second annular ribs 24 and the first annular rib 23 which are positioned on the second surface 213 are connected at the four corners of the annular body 21, so that each second annular rib 24 and the first annular rib 23 positioned on the same surface have a part shared by them. Of course, in a varied embodiment, the second annular ribs 24 may be separate and spaced apart from the first annular rib 23 positioned on the same surface. The first annular ribs 23 encircle the second annular ribs 24 therein, which may further enhance prevention of moisture from seeping into the electronic device from the through holes 92 and the penetrating holes 214.

The third annular ribs 25 are provided on the second surface 213 of the annular body 21 and respectively encircle the positioning posts 22. When the positioning posts 22 pass through the positioning holes 111*c* and are fixed to the positioning holes 111*c*, the third annular ribs 25 abut the abutting face 111*a* of the base portion 111, the third annular ribs 25 and the free end portions 221 of the positioning posts 22 together seal the positioning holes 111*c*, so as to prevent moisture from seeping into the electronic device via the positioning holes 111*c*.

The supporting ribs 26 are provided on the first surface 212 and correspond to the third annular ribs 25 positioned on the second surface 213 in position. The supporting ribs 26 are the same as the first annular rib 23 and the second annular rib 24 in height so as to abut the panel 9 and supplementarily support the third annular ribs 25 respectively, which makes the third annular ribs 25 capable of tightly abutting the abutting face 111*a*.

Figure 8:
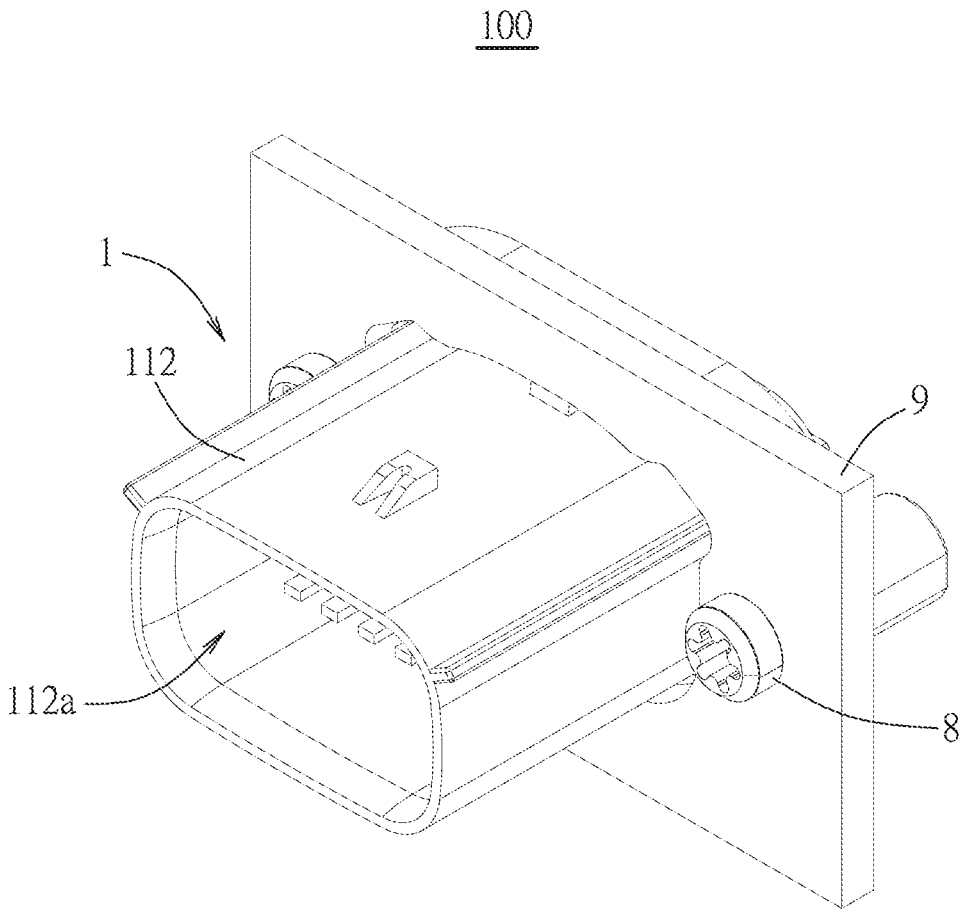
FIG. 8 is a perspective view of a second embodiment of the electrical connection device of the present disclosure.
Figure 9:
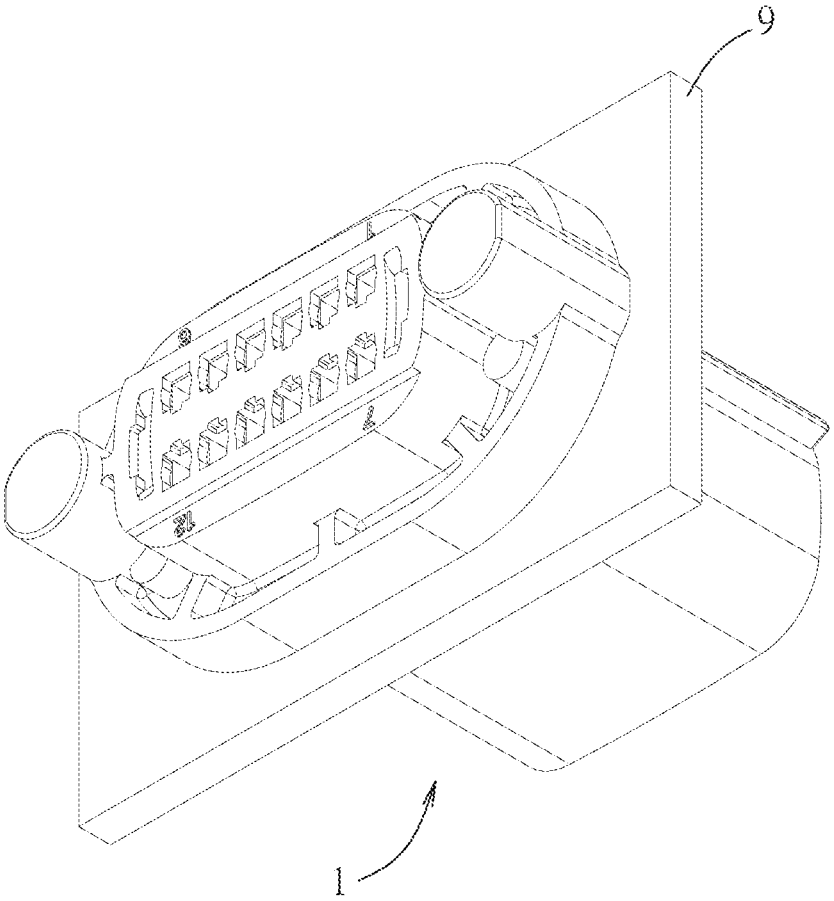
FIG. 9 is a view of FIG. 8 from another angle.

Referring to FIG. 8 and FIG. 9, a second embodiment of the electrical connection device of the present disclosure 100 is adapted to be fixed to a panel 9 of an electronic device (not shown in figures) by two fastener 8. The second embodiment is substantially the same as the first embodiment, and only the deference between the second embodiment and the first embodiment will be described in detail below.

Figure 10:
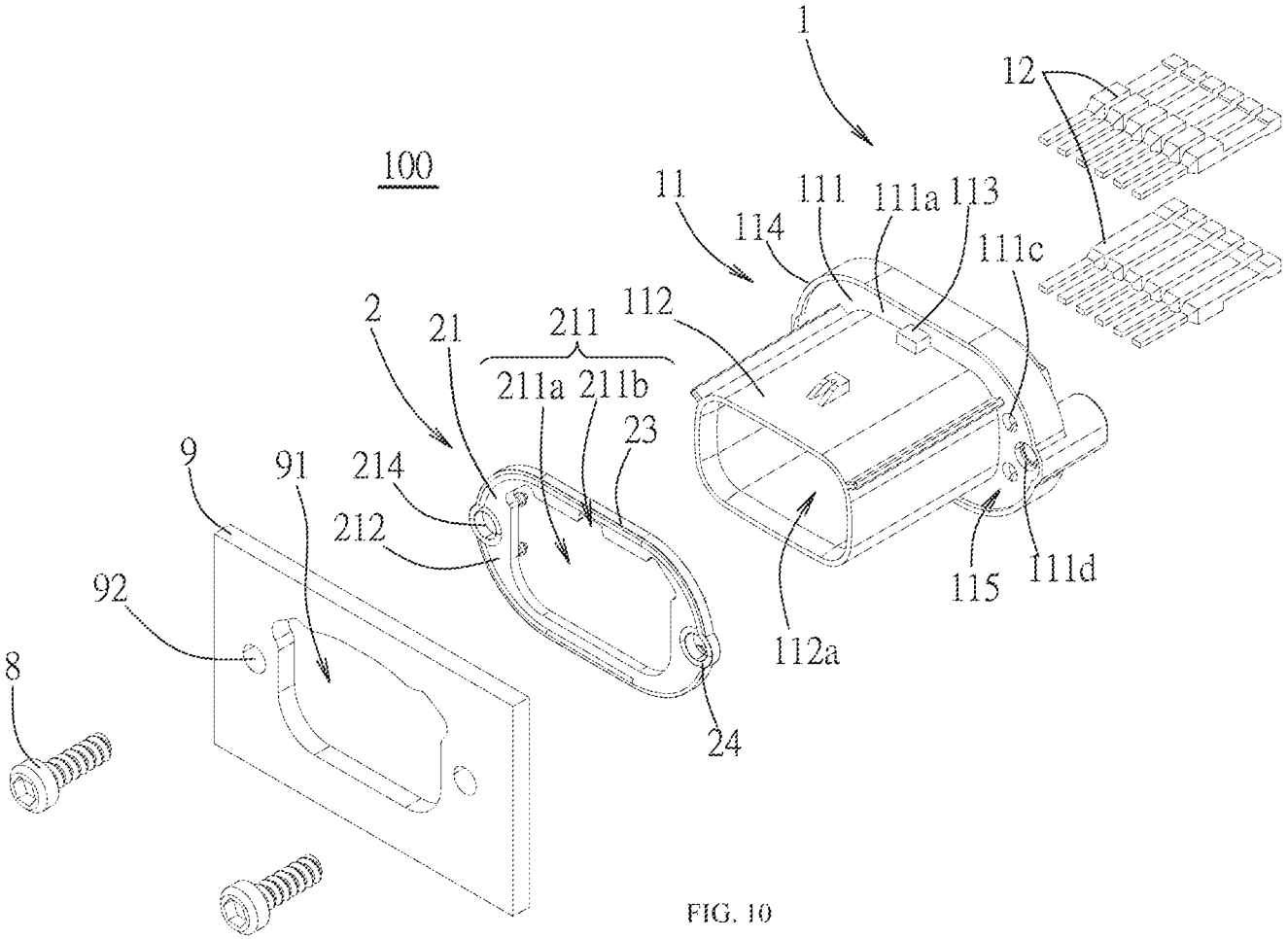
FIG. 10 is an exploded perspective view of the second embodiment.
Figure 11:
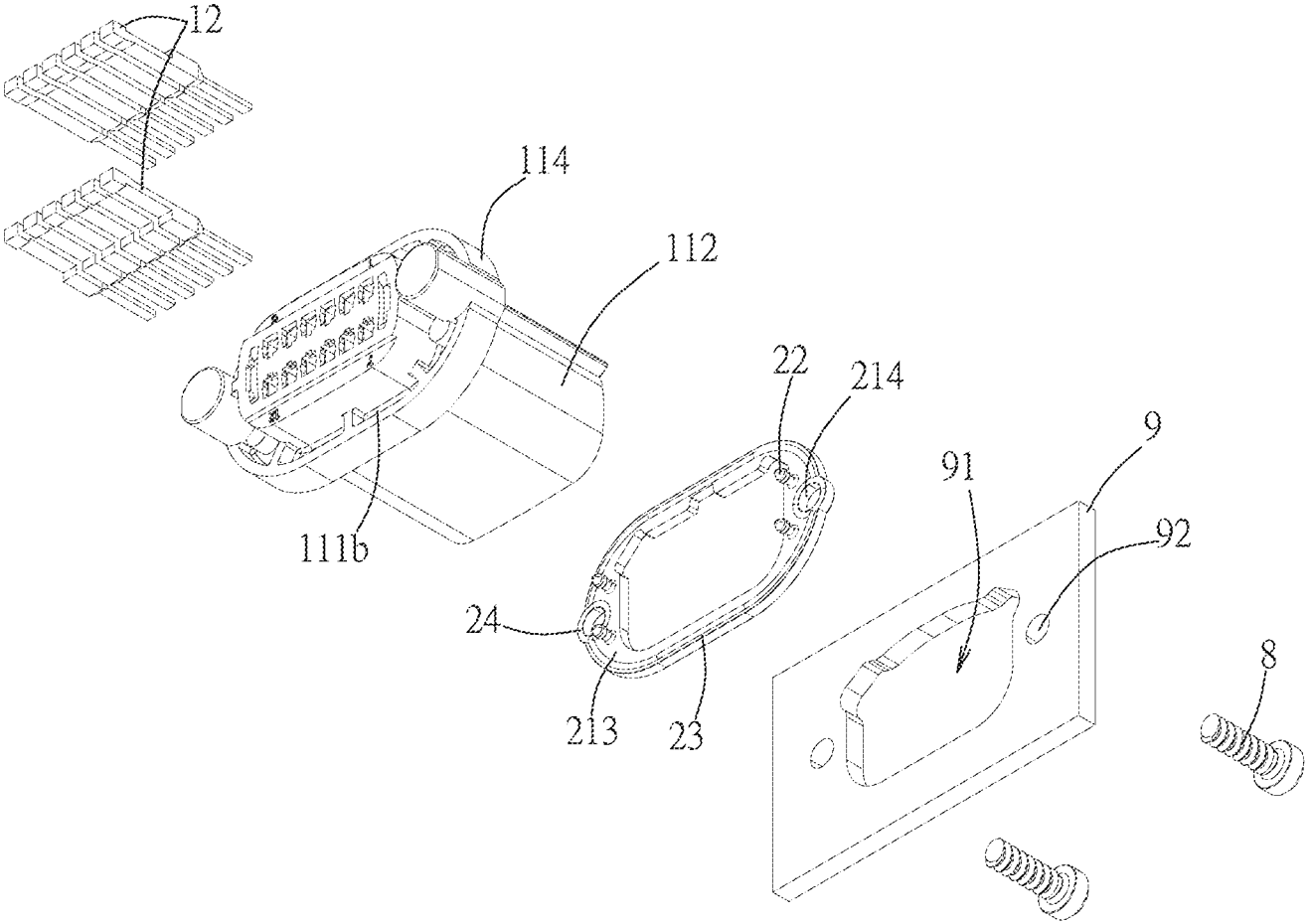
FIG. 11 is a view of FIG. 10 from another angle.
Figure 12:
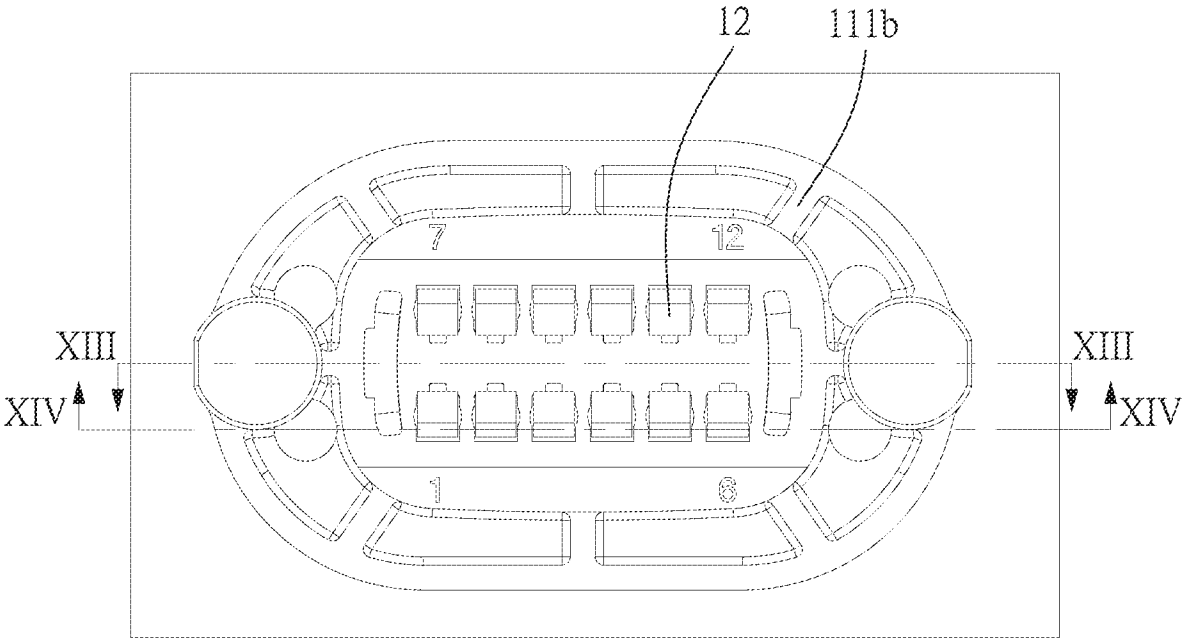
FIG. 12 is a rear view of the second embodiment.

Referring to FIG. 10 to FIG. 12, similarly, the electrical connection device 100 comprises an electrical connector 1 and a sealing member 2. The electrical connector 1 comprises an insulating housing 11 and a plurality of terminals 12. In the embodiment, the base portion 111 of the insulating housing 11 has an elliptical shape. The number of the fastening holes 111*d* of the insulating housing 11 is adjusted to two corresponding to the number of the through holes 92 of the panel 9. The base portion 111 further has four hole walls 111*e* which respectively define the positioning holes 111*c* (see FIG. 14). It should be particularly noted that, comparing to that the positioning hole 111*c* of the first embodiment penetrates the abutting face 111*a* and the rear face 111*b*, the positioning hole 111*c* of the second embodiment is designed as a blind hole which does not penetrate the rear face 111*b*, so that the moisture cannot seep into the electronic device via the positioning hole 111*c*. The plurality of terminals 12 are arranged in two rows in the up-down direction, and similarly, are covered by the base portion 111 of the insulating housing 11 by insert molding technique.

The sealing member 2 comprises an annular body 21, four positioning posts 22, two first annular ribs 23 and four second annular ribs 24. The opening 211 of the annular body 21 has an insertion opening portion 211*a* allowing the mating portion 112 to pass through and a guide opening portion 211*b* extending from an upper side of the insertion opening portion 211*a*, so that the sealing member 2 may be guided to and aligned with the insulating housing 11 by the guide opening portion 211*b* and the guiding portion 113 in the process that the sealing member 2 is assembled to the insulating housing 11, thereby facilitating assembling. In addition, since the number of the penetrating holes 214 of the annular body 21 is adjusted to two, the number of the second annular ribs 24 is correspondingly adjusted to four. The first annular ribs 23 and the second annular ribs 24 are the same as the first embodiment in function, and therefore will not be described again.

Figure 13:
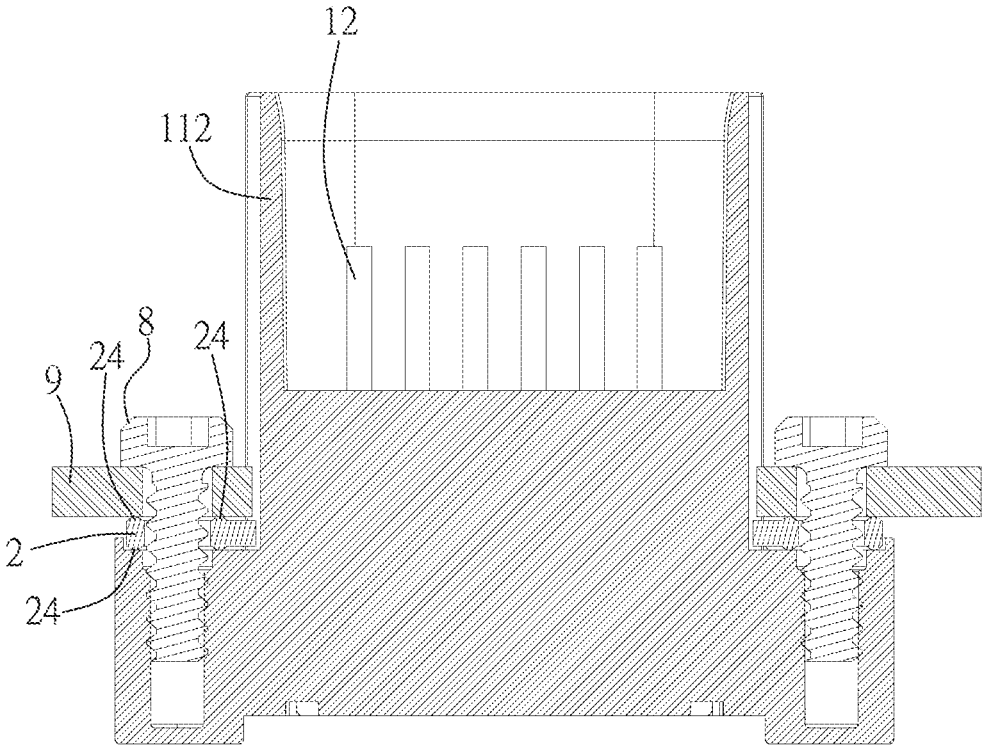
FIG. 13 is a cross-sectional view taken along a line XIII-XIII of FIG. 12.
Figure 14:
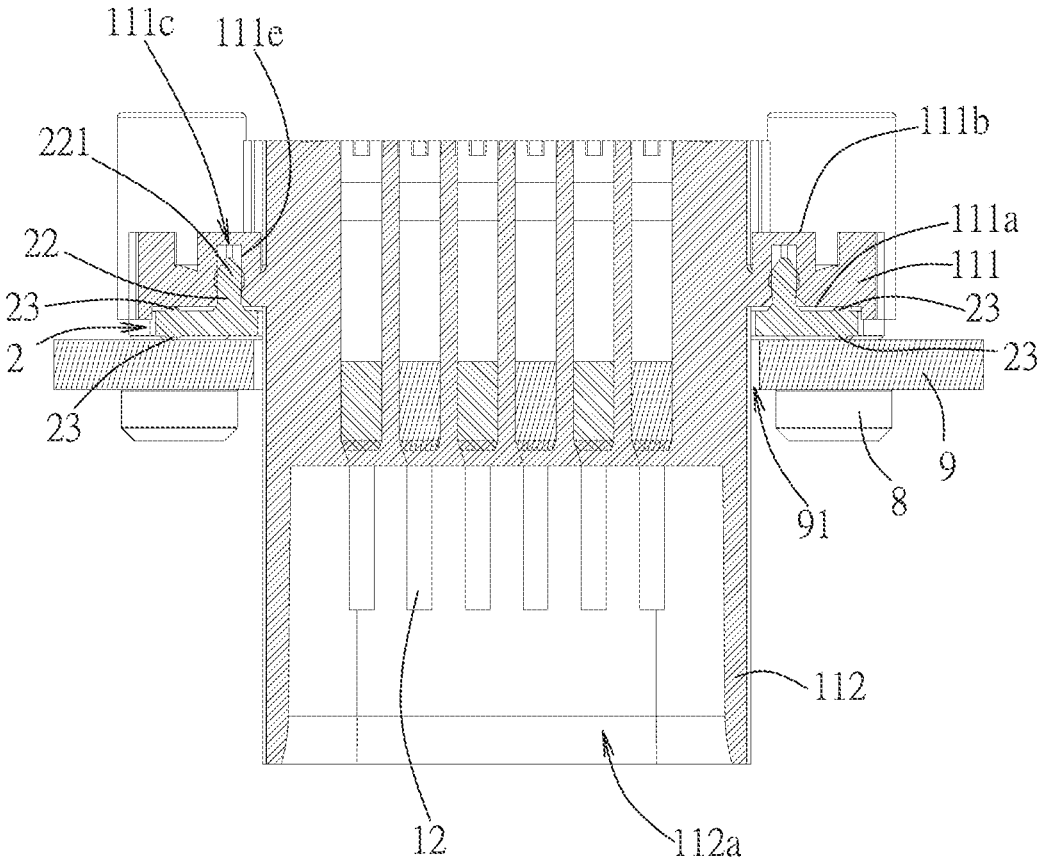
FIG. 14 is a cross-sectional view taken along a line XIV-XIV of FIG. 12.

In combination with referring to FIG. 13 and FIG. 14, similarly, each positioning post 22 has a free end portion 221 which is enlarged. When the positioning posts 22 are inserted into the positioning holes 111*c* of the base portion 111, the free end portions 221 of the positioning posts 22 are squeezed and slightly deformed by the hole walls 111*e*, so that the positioning posts 22 can tightly fitted to the positioning holes 111*c*, and the sealing member 2 and the electrical connector 1 are fixed relative to each other. In addition, it should be noted that since the positioning hole 111*c* of the second embodiment is a blind hole, there is no need to worry that the moisture seeps via the positioning hole 111*c*, therefore, there is no need for the sealing member 2 of the second embodiment to be designed with the third annular rib 25 as the first embodiment (see FIG. 6), which saves the cost of development and manufacturing.

In conclusion, in the electrical connection device 100 of the present disclosure, the first annular ribs 23 are formed on two opposite surfaces of the annular body 21 of the sealing member 2 along the periphery, correspondingly abut the panel 9 and the abutting face 111*a* of the electrical connector 1, so that moisture is prevented from seeping into the electronic device via the mounting hole 91 of the panel 9; furthermore, the second annular rib 24 encircles the penetrating hole 214 of the annular body 21, so that the moisture can also be further prevented from seeping into the electronic device via the through hole 92 of the panel 9; moreover, when the positioning hole 111*c* of the insulating housing 11 is a hole penetrating the base portion 111, the third annular rib 25 around the positioning post 22 of the sealing member 2 and the free end portion 221 of the positioning post 22 are cooperated with each other to seal the positioning hole 111*c*, so that the moisture can be prevented from seeping into the electronic device. Therefore, the object of the present disclosure can be achieved.

However, what is described above is just the embodiments of the present disclosure, which is not intended to limit the scope of the present disclosure, any simple equivalent modifications and variations made according to the claims and the specification of the present disclosure will also be fallen within the scope of the present disclosure.

What is claimed is:

1. An electrical connection device, which is adapted to be fixed to a panel by a plurality of fasteners, the panel having a mounting hole and a plurality of through holes around the mounting hole and respectively allowing the plurality of fasteners to pass through, the electrical connection device comprising:

an electrical connector comprising:

an insulating housing which has a base portion and a mating portion, the base portion having an abutting face, the mating portion protruding from the abutting face, the base portion further having a positioning hole which is formed on the abutting face and positioned around the mating portion and a plurality of fastening holes which are formed on the abutting face and adapted to be respectively aligned with the plurality of through holes of the panel and allow the plurality of fasteners to correspondingly insert therein, and a plurality of terminals which are provided to the insulating housing; and a sealing member which is provided to the insulating housing and is adapted to be abutted between the abutting face and the panel, the sealing member comprising:

an annular body which has an opening allowing the mating portion to pass through, a first surface adapted to face the panel, a second surface facing the abutting face and a plurality of penetrating holes penetrating the first surface and the second surface, the plurality of penetrating holes being respectively adapted to be aligned with the plurality of through holes of the panel and the plurality of fastening holes of the insulating housing so as to allow the plurality of fasteners to correspondingly pass through, two first annular ribs which protrude respectively from the first surface and the second surface and encircle the opening therein, the first annular rib positioned on the first surface being adapted to abut the panel, the first annular rib positioned on the second surface being used to abut the abutting face, a plurality of second annular ribs which protrude respectively from the first surface and the second surface, the second annular ribs positioned on the first surface encircling the plurality of penetrating holes respectively and being adapted to abut the panel, the second annular ribs positioned on the second surface encircling the plurality of penetrating holes respectively and being used to abut the abutting face, and a positioning post which protrudes from the second surface, the positioning post having a free end portion which is enlarged and used to be fixed to the positioning hole.

2. The electrical connection device according to claim 1, wherein each terminal has a fixed portion which is embedded in the base portion of the insulating housing and a contact portion which extends from the fixed portion and exposes to the mating portion.

3. The electrical connection device according to claim 1, wherein the first annular ribs are connected with the plurality of second annular ribs.

4. The electrical connection device according to claim 1, wherein the first annular ribs are adjacent to a periphery of the annular body, and the first annular rib positioned on the second surface encircles the positioning post.

5. The electrical connection device according to claim 1, wherein the plurality of fastening holes are blind holes.

6. The electrical connection device according to claim 1, wherein the base portion further has a rear face which is opposite to the abutting face, the free end portion of the positioning post passes through the positioning hole and abuts the rear face, the sealing member further comprises a third annular rib which is provided to the second surface and encircles the positioning post.

7. The electrical connection device according to claim 1, wherein the positioning hole is a blind hole, the base portion further has a hole wall which defines the positioning hole, the free end portion of the positioning post is tightly fitted to the hole wall.

8. The electrical connection device according to claim 1, wherein the first annular ribs are the same as the plurality of second annular ribs in height.

9. The electrical connection device according to claim 1, wherein the sealing member further has a plurality of supporting ribs which are provided to the first surface, the plurality of supporting ribs are the same as the first annular ribs and the plurality of second annular ribs in height.

10. The electrical connection device according to claim 1, wherein the plurality of fastening holes are threaded holes, the plurality of fasteners are threaded locking members which cooperate with the plurality of fastening holes respectively.

11. The electrical connection device according to claim 1, wherein the positioning post is mushroom-shaped.

12. The electrical connection device according to claim 1, wherein the positioning hole of the base portion is provided as plurality in number, the plurality of positioning holes are distributed around the mating portion, the positioning post of the sealing member is provided as plurality in number, the plurality of positioning posts are respectively cooperated with the plurality of positioning holes.

13. The electrical connection device according to claim 12, wherein the base portion further has a rear face which is opposite to the abutting face, the free end portions of the plurality of positioning posts pass through the plurality of positioning holes respectively and abut the rear face, the sealing member further comprises a plurality of third annular ribs which are provided to the second surface and respectively encircles the plurality of positioning post.

* * * * *